US005595248A

United States Patent [19]

Denny

[11] Patent Number: 5,595,248

[45] Date of Patent: Jan. 21, 1997

[54] PIPE ALIGNMENT APPARATUS

[75] Inventor: Larry Denny, Oklahoma City, Okla.

[73] Assignee: Den-Con Tool Co., Oklahoma City, Okla.

[21] Appl. No.: 519,224

[22] Filed: Aug. 25, 1995

[51] Int. Cl.[6] ..... E21B 19/00; E21B 19/10; E21B 3/04

[52] U.S. Cl. ..... 166/379; 166/85.5; 166/241.6; 166/382

[58] Field of Search ..... 166/379, 241.6, 166/241.1, 77.1, 380, 381, 382, 85.5; 175/220, 85

[56] References Cited

U.S. PATENT DOCUMENTS

| | | | |
|---|---|---|---|
| 2,184,051 | 12/1939 | Moise . | |
| 2,690,847 | 10/1954 | Crookston . | |
| 3,554,278 | 12/1970 | Reistle, III | 166/85 |
| 4,253,219 | 3/1981 | Krasnov | 188/67 |
| 4,440,220 | 4/1984 | McArthur | 175/85 X |
| 4,440,536 | 4/1984 | Scaggs | 175/85 X |
| 4,591,007 | 5/1986 | Shaginian et al. | 175/85 |
| 4,676,312 | 6/1987 | Mosing et al. | 166/381 X |
| 4,681,158 | 7/1987 | Pennison | 166/77.51 |

*Primary Examiner*—Stephen J. Novosad
*Attorney, Agent, or Firm*—Dunlap & Codding, P.C.

[57] ABSTRACT

An apparatus and method for centering a pipe string within a slip bowl to facilitate the setting of a set of slips about the pipe string wherein the slip bowl is disposed in a floor of a drilling rig and the pipe string is suspended from the drilling rig so that the pipe string extends downwardly through the slip bowl and into a well bore. In one embodiment, the apparatus includes at least two pairs of hydraulic cylinders mounted beneath the rig floor about the centerline of the slip bowl. Each pair of cylinders connected by a flexible cable through which the pipe string is run. The pipe string is centered by actuating the cylinders to a retracted position thereby forcibly drawing the pipe string to the center of the slip bowl. Alternatively, the cylinders are provided with a pipe engaging member configured for guiding engagement with the pipe string to push the pipe string into alignment with the center of the slip bowl when the cylinders are actuated to an extended position.

21 Claims, 5 Drawing Sheets

PIPE ALIGNMENT APPARATUS

BACKGROUND OF THE INVENTION

1. Field of the Invention.

The present invention relates generally to pipe aligning devices, and more particularly, by not by way of limitation, to an apparatus for centering a pipe string in a slip bowl disposed in a drilling rig floor to facilitate setting a set of slips about the pipe string.

2. Description of Related Art.

During the drilling, completion and work-over of oil and gas wells, it is necessary to insert into and remove from the well bore a string of pipe (e.g., drill string, casing string, or tubing string). Whether forming the string or breaking the string apart, the pipe string is suspended from the rig floor as additional sections of pipe are either added to or removed from the string. Suspension of the string from the rig floor is accomplished in a manner well known in the art by the use of a slip and bowl set.

The bowl is disposed in the rig floor and includes an internal tapered surface. The slips, on the other hand, include a serrated inner surface and an external tapered surface whereby the slips are wedged between the pipe and the slip bowl when the internal surface of the slips grippingly engage the pipe thereby supporting the pipe from the rig floor. The slips are disposed about the pipe string while the pipe string is suspended from an elevator provided on the rig for hoisting and lowering pipe. Slip designs include both manual slips and power slips. Manual slips, which are constructed of a plurality of hinged slip segments, are manually disposed between the pipe and the slip bowl, while power slips are automatically disposed about the pipe with either spring, pneumatic or hydraulic power.

A problem often encountered when attempting to position both manual slips and power slips about the pipe string is that the string is not centered in the slip bowl due to a variety of variables including the fact that the elevator is typically not centered directly over the slip bowl. This misalignment of the pipe relative to the slip bowl causes placement of the slips around the pipe whereby the slips can engage the pipe to be difficult. With manual slips, the center slip segment can often be forcibly wedged between the pipe and the slip bowl when the pipe string is misaligned, and in turn, dragged into the slip bowl by the weight of the pipe. However, this can result in significant damage being incurred to the pipe, the slips and the slip bowl. Power slips are designed primarily to work on and around the center line of the slip bowl and it is generally not possible to position the slips so that the slips can be wedged between the pipe and the bowl when the pipe string is misaligned.

To this end, a need exists for an apparatus for centering a string of pipe in a slip bowl disposed in a drilling rig floor to facilitate setting the slips about the pipe string prior to attempting to set the slip in the bowl. It is to such an apparatus that the present invention is directed.

BRIEF DESCRIPTION OF THE DRAWINGS

FIG. 6 is a diagonal view of the apparatus of FIG. 5A.

DETAILED DESCRIPTION

Figure 1:
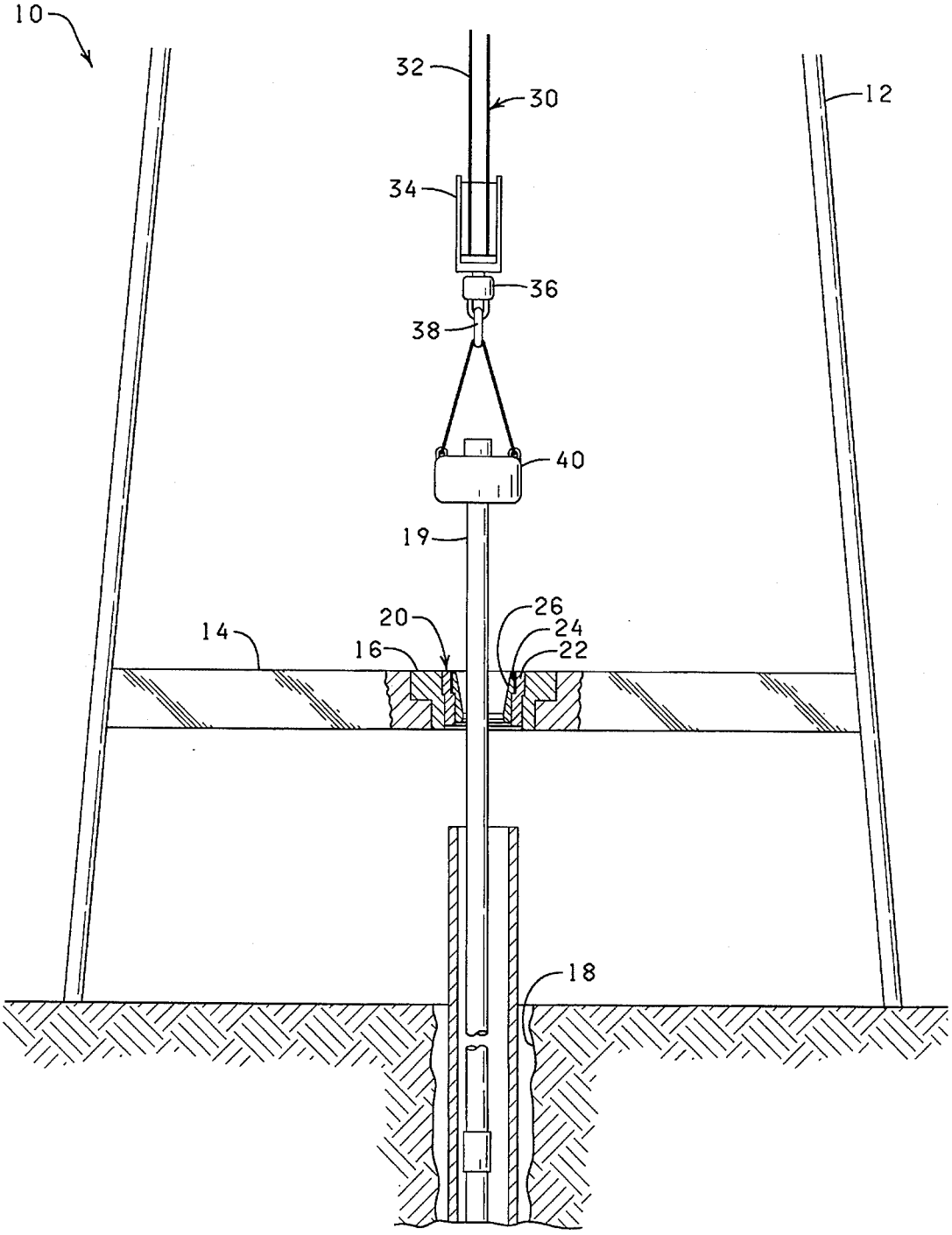
FIG. 1 is an elevational view of a portion of a drilling rig showing a pipe string suspended from an elevator and through a slip bowl disposed on the rig floor.
Figure 2:
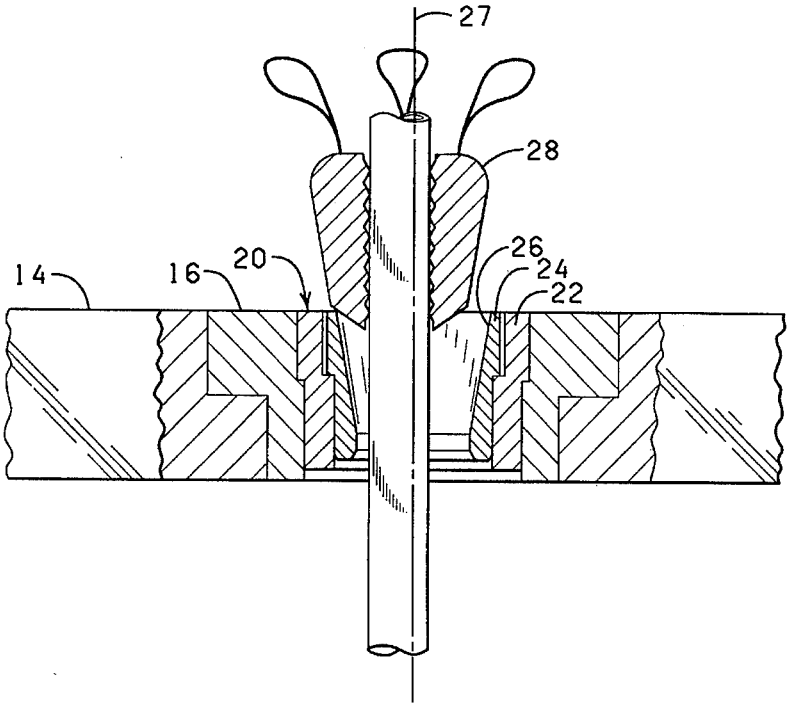
FIG. 2 is an elevational view, partially in cross section, of a slip bowl illustrating a set of slips partially disposed about the pipe string.

Referring now to the drawings, and more particularly to FIGS. 1 and 2, a conventional rotary drilling rig 10 is illustrated. The drilling rig 10 includes a vertically extending derrick or mast 12 which is erected above a rig floor 14. At the rig floor 14, a rotary table 16 is utilized for rotating drill pipe in the drilling of a well bore 18. The rotary table 16 is also used for suspending a pipe string 19 as additional sections of pipe are either added to or removed from the pipe string. In using the rotary table 16, a bushing 20 is employed in the rotary table 16. The bushing 20 includes a bushing body 22 and a slip bowl 24 which is provided with a tapered inner surface 26. The slip bowl 24 is further characterized as having a centerline 27 extending vertically therethrough. The pipe string 19 is suspended from the rotary table 16 by wedging a set of wedge-shaped slips 28 (FIG. 2) between the pipe string 19 and the slip bowl 24 in a manner well know in the industry.

A hoist 30 is provided on the drilling rig 10 for hoisting and lowering sections of pipe. The hoist 30 includes a crown block (not shown) located at the top of the derrick 12, a drilling line 32, a traveling block 34, a swivel 36, and hook 38, and an elevator 40. The components and operation of drilling rigs and the manner in which sections of pipe are raised and lowered are well known in the art, thus no further description of the components or operation of the drilling rig 10 is believed necessary in order to enable one skilled in the art to understand the apparatus of the present invention and the relationship of the apparatus to the drilling rig 10.

Due to the numerous components that make up the hoist 30, it is virtually impossible to have the elevator 40, which is connected to the end of the pipe string 19, to be centered directly over the center of the slip bowl 24 so that the pipe string 19 is aligned with the center line 27 of the slip bowl 24 when the pipe string 19 is suspended from the hoist 30. As a result, the pipe string 19 is often misaligned with the slip bowl 24 which in turn poses difficulties when attempting to set the slips 28 between the pipe string 19 and the slip bowl 24 in view of the fact that the pipe string 19 can weigh several hundred tons. As illustrated in FIG.2, the difficulty occurs because the bottom of the slips 24 cannot be inserted between the pipe string 19 and the slip bowl 24 with the pipe string 19 misaligned in the slip bowl 24. For the slips 24 to work properly, it is necessary that the pipe string 19 to be centered in the slip bowl 24.

Figure 3:
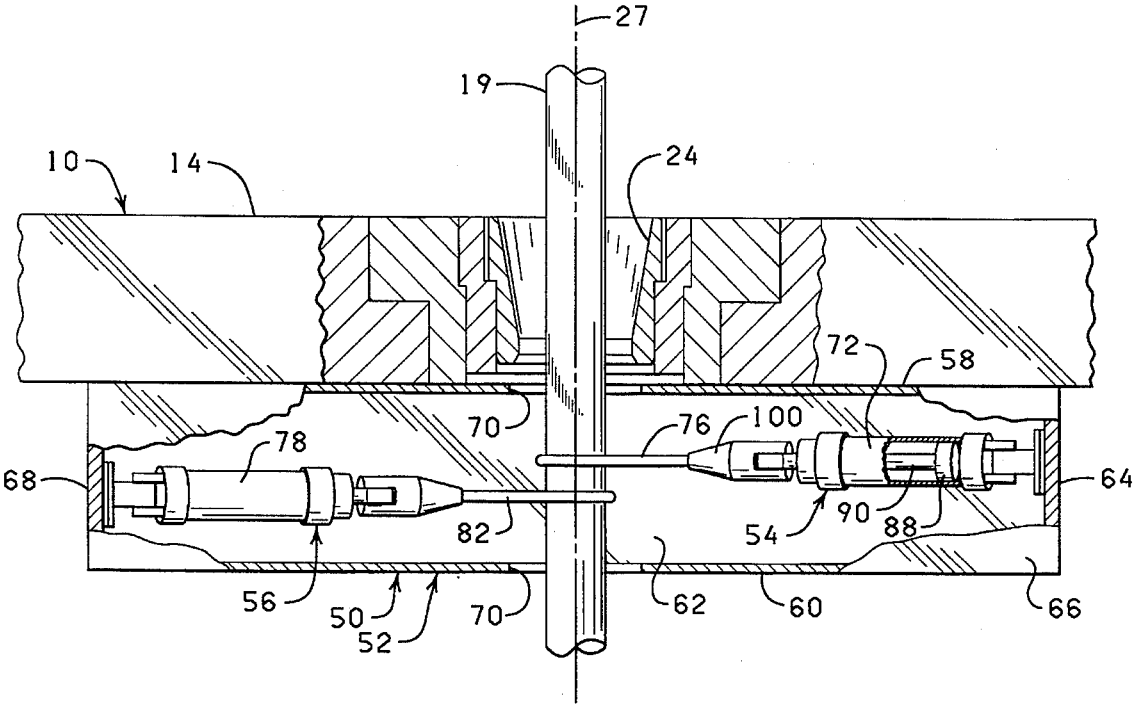
FIG. 3 is a partially cutaway, front view of an apparatus for centering a pipe string constructed in accordance with the present invention illustrated mounted below the rig floor and in a retracted position.
Figure 4A:
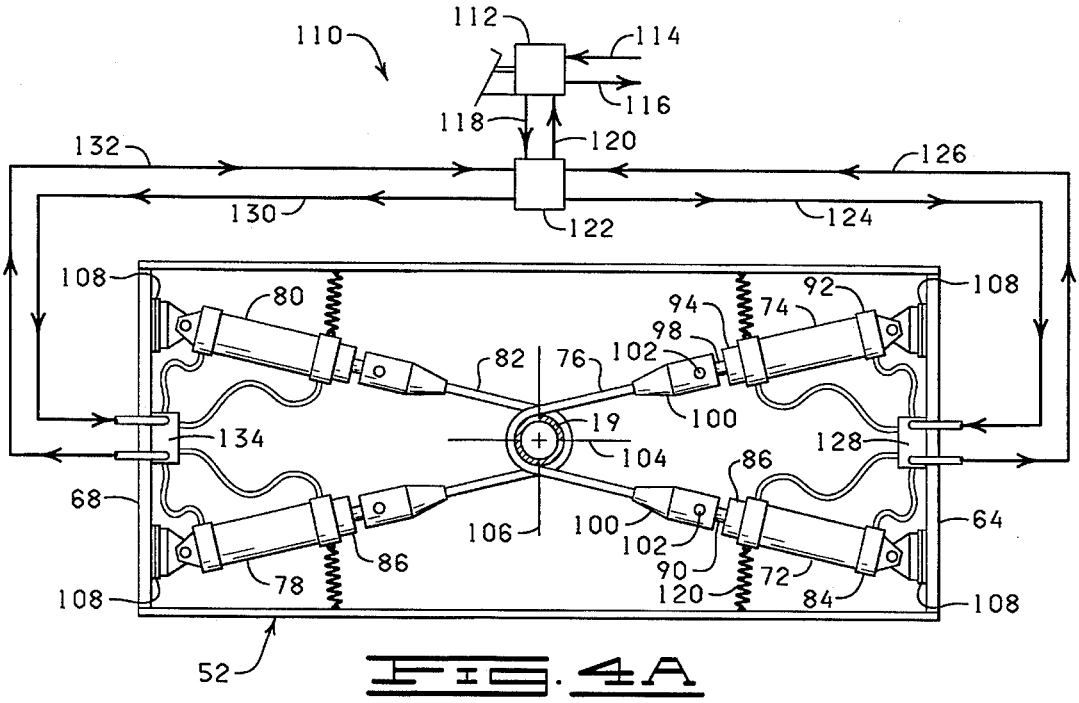
FIG. 4A is a top view of the apparatus of the present invention illustrated in the retracted position.
Figure 4B:
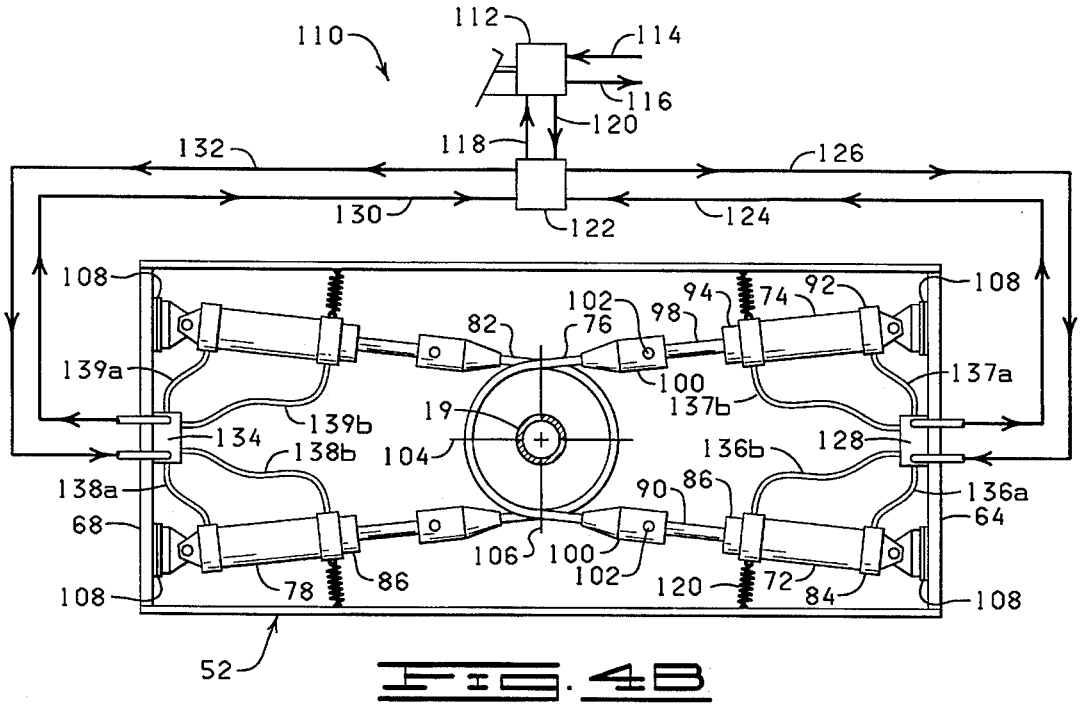
FIG. 4B is a top view of the apparatus of the present invention illustrated in an extended position.

FIGS. 3, 4A, and 4B illustrate an apparatus 50 constructed in accordance with the present invention for centering the pipe string 19 in the slip bowl 24 to facilitate setting the slips 28 about the pipe string 19. The apparatus 50 is positioned below the rig floor 14 in the substructure of the rig 10 to eliminate congestion and clutter on the rig floor. Broadly, the apparatus 50 includes a housing 52, and a pair of pipe engaging assemblies 54 and 56 mounted within the housing 52.

The housing 52 is mounted below the floor 14 of the rig 10 in the substructure of the rig 10. The housing 52 includes an upper plate 58, a lower plate 60, a first side 62, a second side 64, a third side 66 and a fourth side 68. The upper and lower plates 58 and 60 are formed from steel plate while the sides 62–68 are formed from channel beams, I-beams or other suitable support members. The upper and lower plates 58 and 60 are each provided with an opening 70 for receiving the pipe string 19 so as to allow the pipe string 19 to extend through the housing 52. The housing 52 can be mounted to the rig 10 in any suitable fashion, such as bolting or welding the upper plate 58 to the floor 14 of the rig 10.

As best shown in FIGS. 4A and 4B, the pipe engaging assembly 54 comprises a pair of cylinders 72 and 74 interconnected by a flexible cable or wire rope 76, and the pipe engaging assembly 56 comprises a pair of cylinders 78 and 80 interconnected by flexible cable or wire rope 82. The pipe engaging assemblies 54 and 56 are identical in construction, thus only the pipe engaging assembly 54 will be described in detail hereinafter.

The cylinder 72 has a first end 84, a second end 86, a piston 88 (FIG. 3) slidingly disposed therein, and a rod 90 having one end connected to the piston 88 and the other end or distal end extending from the second end 86 of the cylinder 72. Similarly, the cylinder 74 has a first end 92, a second end 94, a piston (not shown) slidingly disposed therein, and a rod 98 having one end connected to the piston and the other end or distal extending from the second end 94 of the cylinder 74. The cylinders 72 and 74 are double-acting hydraulic cylinders. While it will be appreciated that the size of the cylinders 72 and 74 can be varied, it is important that the cylinders be of sufficient size to produce a force sufficient to move the pipe string 19, which as stated above can weigh several hundred tons.

The cable 76, which functions to engage the pipe string 19, has one end connected to the distal end of the rod 90 and the other end connected to the distal end of the rod 98. To facilitate the connection of the cable 76 to the rods 90 and 98, the ends of the cable 76 are fixed to a cable connector 100. Each cable connector 100 is adapted to be pivotally connected to the distal end of one of the rods 90 and 98. The cable connectors 100 are attached to the rods 90 and 98 with a pivot pin 102.

The pipe engaging assemblies 54 and 56 are mounted in the housing 52 in an opposing relationship relative to one another by mounting the pipe engaging assemblies 54 and 56 to opposing sides of the housing 52, such as by mounting the pipe engaging assembly 54 to second side 64 of the housing 52 and the pipe engaging assembly 56 to fourth side 68 of the housing 52, for example. The first ends 84 and 92 of the cylinders 72 and 74, respectively, and the first ends of the cylinders 78 and 80 are pivotally connected to the housing 52 so that the cylinders 72, 74, 78, and 80 are rotatable along a plane perpendicular to the centerline 27 of the slip bowl 24, the significance of which will be described below. The cylinders 72 and 74 of the pipe engaging assembly 54 are connected to the housing 52 so that the first ends 84, 92 of the cylinders 72 and 74, respectively, of the pipe engaging assembly 54 are symmetrically spaced relative to a first axis 104 extending perpendicular from the centerline 27 of the slip bowl 24. Likewise, the first ends of the cylinders 78 and 80 of the pipe engaging assembly 56 are symmetrically spaced relative to the first axis 104, but in an opposing relation such that the cylinders 72 and 74 of the pipe engaging assembly 54 and the cylinders 78 and 80 of the pipe engaging assembly 56 are symmetrically spaced relative to a second axis 106 which is perpendicular to the centerline 27 of the slip bowl 24 and perpendicular to the first axis 104.

With the pipe assemblies 54 and 56 mounted in the housing 52, the pipe string 19 is run through the cables 76 and 82 as substantially shown such that the cables 76 and 82 are looped about the pipe string 19.

The cylinders 72, 74, 78 and 80 are selectively movable from an extended position (FIG. 4B) wherein the cables 76 and 82 are in a non-engaging relation with the pipe string 19 to a retracted position (FIGS. 3 and 4A) wherein the cables 76 and 82 cooperatively engage the pipe string 19 so as to forcibly draw the pipe string 19 to the centerline 27 of the slip bowl 24. FIGS. 4A and 4B illustrate a typical plumbing assembly 110 which can be used to operate the cylinders. The cylinders 72, 74, 78 and 80 are operated by hydraulic pressure provided by the rig hydraulic power unit (not shown) or with the use of a separate hydraulic power unit (also not shown).

The plumbing assembly 110 includes a control valve 112 preferably located in the driller's console (not shown) on the rig floor 14. The control valve 112 can be any suitable valve, such as a 3-position treadle operated valve. A pressure line 114 from the hydraulic power unit is connected to the control valve 112 and a return line 116 is connected to the control valve 112. From the other side of the control valve 112, a flow line 118 and a flow line 120 are connected to a first flow divider 122. From the flow divider 122, a flow line 124 and a flow line 126 are connected to a second flow divider 128. Similarly, a flow line 130 and a flow line 132 are run from the flow divider 122 to a third flow divider 134. Flow lines 136*a*, 136*b* and 137*a*, 137*b* are run from the second flow divider 128 to the first and second ends of the cylinders 72 and 74, respectively, and flow lines 138*a*, 138*b* and 139*a*, 139*b* are run from the third flow divider 134 to the first and second ends of the cylinder 78 and 80, respectively.

In operation, the control valve 112 has three settings: engage, disengage, and neutral. In the engage position (FIG. 4A), hydraulic pressure from the pressure line 114 is directed from the control valve 112 through flow lines 124 and 130, through the flow dividers 128 and 134, respectively, and through flow lines 136b, 137*b* and 138*b*, 139*b*, respectively, thereby actuating the cylinders 72, 74, 78, and 80 to the retracted position. In the disengage position (FIG. 4B), hydraulic pressure from the pressure line 114 is directed from the control valve 112 through flow lines 126 and 132, through the flow dividers 128 and 134, respectively, and through flow lines 136*a*, 137*a* and 138*a*, 139*a*, respectively, thereby actuating the cylinders 72, 74, 78, and 80 to the extended position. It will be appreciated by those skilled in the art that the fluid control assembly 110 described above is one manner of operating the cylinders and that a variety of other hydraulic configurations can be utilized to control the cylinders in accordance with the present invention. For instances, the control valve 112 can be used to pilot operate larger valves if such valves are required.

To ensure that the cables 76 and 82 remain in a non-engaged relation with the pipe string 19 in order to not interfere with well operations when the rods of the cylinders 72, 74, 78, and 80 are in the extended position, the second end of each of the cylinders 72, 74, 78, and 80 are biased outwardly from the pipe string 19 via a tension spring 120 or other suitable device, such as an elastic band. Each of the springs 120 has one end attached near the second end of one of the cylinders 72, 74, 78 and 80 and the other end of the spring 120 is attached to the housing 52 such that the spring 120 urges the second end of the cylinders 72, 74, 78 and 80 away from the pipe string 19 when the cylinders 72, 74, 78 and 80 are in the extended position, thereby moving or projecting the cables 76 and 82 away from the pipe string 19 in manner as substantially shown in FIG. 4B.

To allow the apparatus 50 to be easily adapted for use with pipe of different sizes without risking damage being incurred to the pipe string 19, a spacer or washer 108 is disposed at the first end of cylinder 72, 74, 78 and 80 to adjust the distance of the cylinders 72, 74, 78 and 80 from the centerline 27 of the slip bowl 24 so that the cylinders 72, 74, 78 and 80 are fully retracted when the pipe string 19 is pulled into alignment with the centerline 27 of the slip bowl 24.

When it is desired to set the slips 28 (FIG. 2) about the pipe string 19 in order to suspend the pipe string 19 from the floor 14 of the rig 10, an operator actuates the cylinders 72, 74, 78 and 80 with the control valve 112. The cylinders 72, 74, 78 and 80 are simultaneously retracted thereby drawing the pipe string 19 to the centerline 27 of the slip bowl 24. As illustrated in FIG. 4A, the pivot connection of the first end of the cylinders 72, 74, 78 and 80 allows the rods to be tangentially aligned with the pipe string 19 when the cylinders 72, 74, 78 and 80 are retracted thereby aligning the rods with the load and reducing strain on the rods.

When the slips 28 have been set about the pipe string 19, the cylinders 72, 74, 78 and 80 are moved to the extended position so as to relax the cables 76 and 82.

Figure 5A:
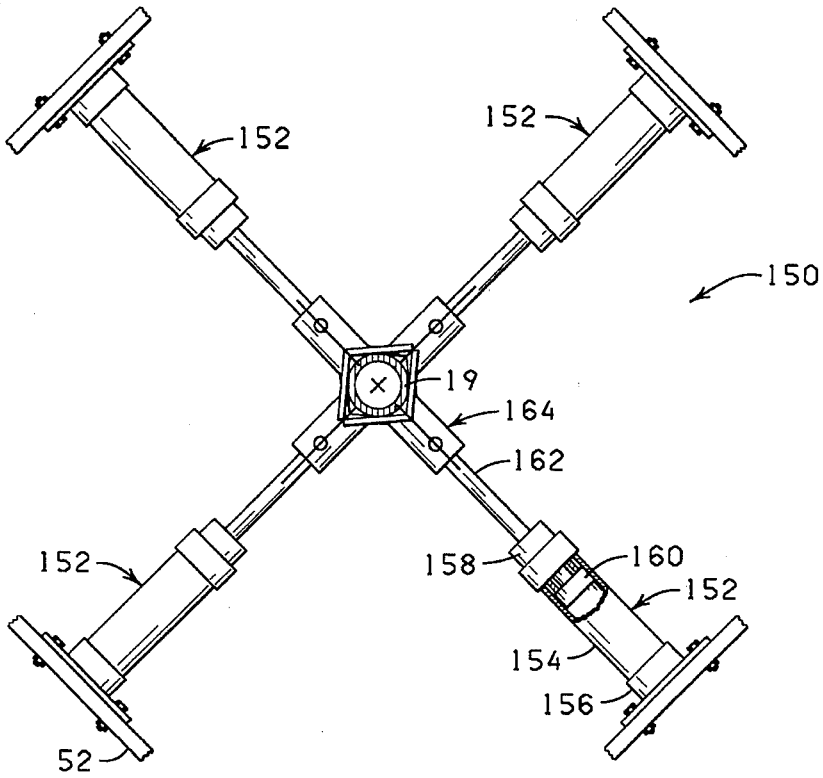
FIG. 5A is a top view of another embodiment of an apparatus for centering a pipe string constructed in accordance with the present invention illustrated in an extended position.
Figure 5B:
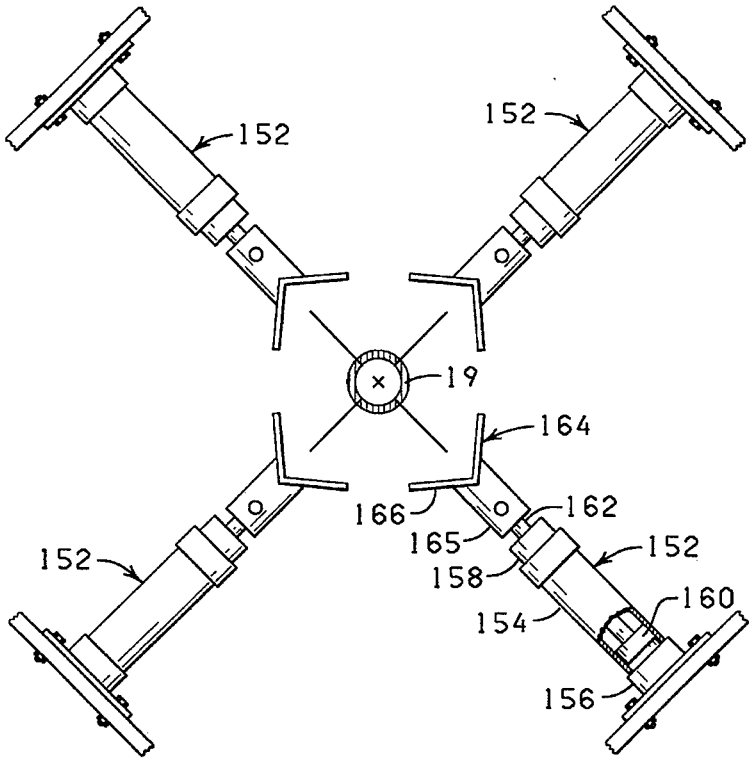
FIG. 5B is a top view of the apparatus of FIG. 5A illustrated in a retracted position.

FIGS. 5A, 5B and 6 illustrate another embodiment of an apparatus 150 constructed in accordance with the present invention for centering the pipe string 19 in the slip bowl 24 to facilitate setting the slips 28 about the pipe string 19. Like the apparatus 50 described above, the apparatus 150 is positioned below the rig floor 14 in the substructure of the rig 10 to eliminate congestion and clutter on the rig floor 14. The apparatus 150 includes a plurality of pipe engaging assemblies 152 rigidly mounted to the housing 52 such that the pipe engaging assemblies 152 extend radially inward toward the centerline 27 of the slip bowl 24. Each of the pipe engaging assemblies 152 are identical in construction, thus only one of the pipe engaging assemblies 152 will be referred to in the description of pipe engaging assemblies 152 below.

Each of the pipe engaging assemblies 152 includes a cylinder 154 having a first end 156, a second end 158, a piston 160 slidingly disposed therein, and a rod 162 having one end connected to the piston 160 and the other end or distal end extending from the second end 158 of the cylinder 154. The cylinders 154 are double-acting hydraulic cylinders. While it will be appreciated that the size of the cylinders 154 can be varied, it is important that the cylinder be of sufficient size to produce a force sufficient to move the pipe string 19, which as stated above can weigh several hundred tons.

The distal end of each rod 160 is provided with a pipe engaging member 164 configured to extended about a portion of the pipe string 19. Each of the pipe engaging members 164 includes a coupling portion 165 for connection with the rod 162 and a portion 166 configured to capture the pipe string 19 when the pipe string 19 is misaligned with the center of the slip bowl 24. The pipe engaging portion 166 is shown to be wedge-shaped but can be configured in another suitable shape, such as arcuate. In addition, the pipe engaging portion 166 may be provided with a cushioning material, such as rubber, on the inner surface thereof to protect the pipe string 19 from damage.

To enable the pipe engaging members 164 to engage the pipe string 19 without interference from the adjacent pipe engaging members 164, the adjacent cylinders are vertically spaced substantially as illustrated in FIG. 6.

Figure 5:
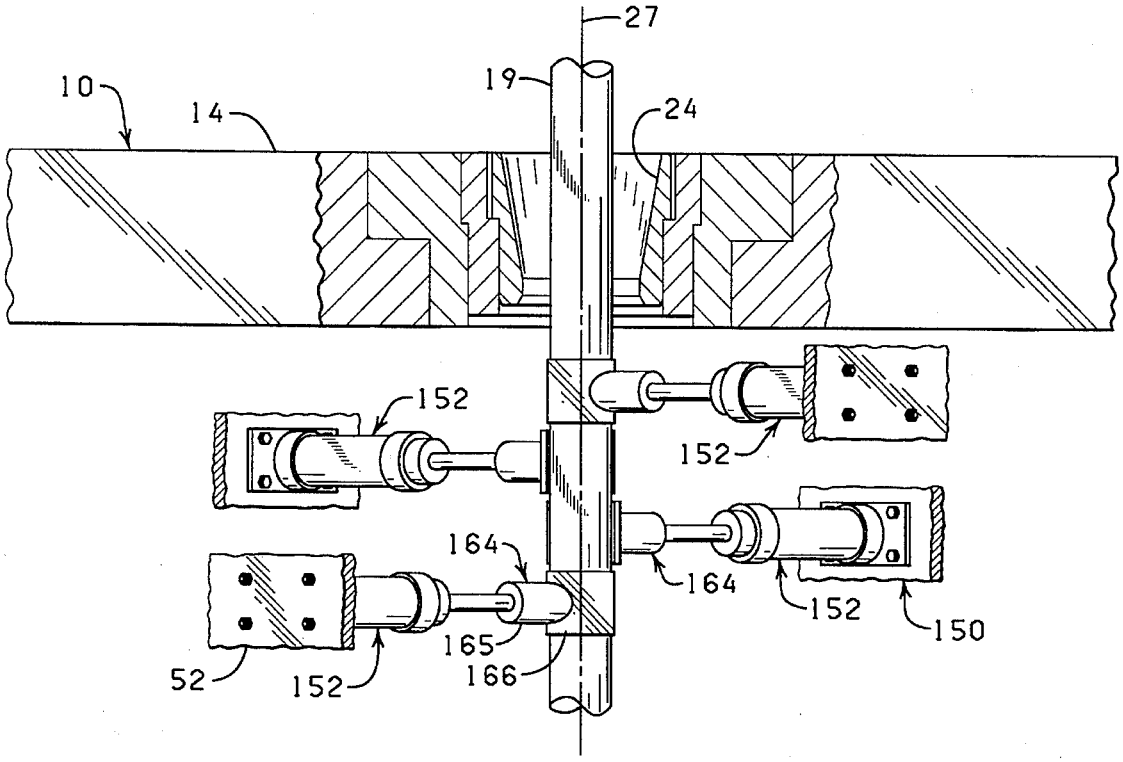

Although not illustrated in FIGS. 5 and 6, it will be understood that the cylinders 154 are hydraulically operated in a manner similar to that described above in reference to the apparatus 50 with the exception that when the cylinders 154 are actuated to the extended position (FIGS. 5A and 6), the pipe engaging members 162 contact the pipe string 19 and push the pipe string 19 to the centerline 27 of the slip bowl and when the cylinders 154 are actuated to the retracted position, the pipe engaging members 164 are non-engaged with the pipe string 19.

To center the pipe string 19 in the slip bowl 24, the operator actuates the cylinders 154 to the extended position whereby the cylinders extend radially inward from the retracted position to the extended position and cooperatively push the pipe string 19 to the centerline 27 of the slip bowl 24. When the slips 28 are set about the pipe string 19, the cylinders 154 are moved to the retracted position so as to disengage the pipe string 19.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed:

1. An apparatus for centering a pipe string within a slip bowl to facilitate the setting of a set of slips about the pipe string, the slip bowl disposed in a floor of a drilling rig and the pipe string suspended from the drilling rig so that the pipe string extends downwardly through the slip bowl and into a well bore, the apparatus comprising:

pipe engaging means for selectively engaging a portion of the pipe string from below the floor of the rig and moving the pipe string into alignment with the center of the slip bowl.

2. The apparatus of claim 1 wherein the center of the slip bowl defines a centerline, and wherein the pipe engaging means comprises:

a first pair of cylinders, each cylinder having a first end, a second end, a piston slidingly disposed therein, and a rod connected to the piston and extending from the second end of the cylinder;

a first cable having one end connected to one of the rods of the first pair of cylinders and the other end connected to the other cylinder, the first cable being looped about at least a portion of the pipe string;

a second pair of cylinders, each cylinder having a first end, a second end, a piston slidingly disposed therein, and a rod connected to the piston and extending from the second end of the cylinder;

a second cable having one end connected to one of the rods of the second pair of cylinders and the other end connected to the other cylinder, the second cable being looped about an opposing portion of the pipe string; and actuating means for selectively actuating the rods of the first and second pairs of cylinders between an extended position where the first and second cables are in a nonengaging relation with the pipe string and a retracted position where the first and second cables cooperatively engage the pipe string so as to move the pipe string into alignment with the center of the slip bowl.

3. The apparatus of claim 2 wherein the first ends of the cylinders of the first pair of cylinders are symmetrically spaced relative to a first axis extending perpendicular from the centerline of the slip bowl, wherein first ends of the cylinders of the second pair of cylinders are symmetrically spaced relative to the first axis, and wherein the first and second pair of cylinders are symmetrically spaced relative to a second axis, the second axis being perpendicular to the centerline of the slip bowl and perpendicular to the first axis.

4. The apparatus of claim 2 wherein each of the first and second cables are flexible, and wherein each of the cylinders of the first and second pair of cylinders is pivotally connected to the rig so that the cylinders are movable along a plane perpendicular to the centerline of the slip bowl whereby the rods of the first and second pair of cylinders tangentially align with the pipe string when the rods are in the retracted position.

5. The apparatus of claim 4 further comprising:

biasing means for urging the first end of each of the cylinders outwardly from the pipe string when the rods are in the extended position to project the first and second cables away from the pipe string in a non-engaging relation when the rods are in the extended position.

6. The apparatus of claim 1 further comprising:

a housing mounted to the rig underneath the floor thereof, the housing configured to receive the pipe string and substantially encase the pipe engaging means.

7. The apparatus of claim 1 wherein the center of the slip bowl defines a centerline, and wherein the pipe engaging means comprises:

a plurality of cylinders, each cylinder having a first end, a second end, a piston slidingly disposed therein, and a rod connected to the piston and extending from the second end of the cylinder, the first end of each cylinder connected to the rig below the floor thereof such that the cylinders are radially positioned relative to the centerline of the slip bowl and spaced substantially an equal distance apart;

a pipe engaging member provided at the second end of each rod;

actuating means for selectively actuating the rods of the cylinders between a retracted position where the pipe engaging members are in a non-engaging relation with the pipe string and an extended position where the pipe engaging members cooperatively engage the pipe string so as to push the pipe string into alignment with the center of the slip bowl.

8. The apparatus of claim 7 wherein adjacent pipe engagement members are vertically spaced apart.

9. A method for centering a pipe string within a slip bowl to facilitate the setting of a set of slips about the pipe string, the slip bowl disposed in a floor of a drilling rig and the pipe string suspended from the drilling rig so that the pipe string extends downwardly through the slip bowl and into a well bore, the method comprising the steps of:

selectively engaging the pipe string from below the floor of the rig so as to align the pipe string with the center of the slip bowl.

10. A method for setting a set of slips in a slip bowl wherein the slip bowl is disposed in a floor of a drilling rig and the pipe string is suspended from the drilling rig so that the pipe string extends downwardly through the slip bowl and into a well bore, the method comprising the steps of:

engaging the pipe string from below the floor of the rig and moving the pipe string so as to align the pipe string with the center of the slip bowl; and installing the slips between the pipe string and the slip bowl.

11. The method of claim 10 wherein the engaging steps comprises:

providing a first pair of cylinders, each cylinder having a first end, a second end, a piston slidingly disposed therein, and a rod connected to the piston at one end and extending from the second end of the cylinder, the first end of each cylinder connected to the rig such that the cylinders are symmetrically spaced relative to a first axis extending perpendicular from the centerline of the slip bowl, the rods of the first pair of cylinders being interconnected with a first cable looped about a portion of the pipe string;

providing a second pair of cylinders, each cylinder having a first end, a second end, a piston slidingly disposed therein, and a rod connected to the piston at one end and extending from the second end of the cylinder, the first end of each cylinder connected to the rig such that the second pair of cylinders are symmetrically spaced relative to the first axis and such that the first and second pair of cylinders are symmetrically spaced relative to a second axis, the second axis being perpendicular to the centerline of the slip bowl and perpendicular to the first axis, the rods of the second pair of cylinders being interconnected with a second cable looped about an opposing portion of the pipe string; and selectively actuating the rods of the first and second pairs of cylinders between an extended position where the first and second cables are in a nonengaging relation with the pipe string and a retracted position where the first and second cables cooperatively engage the pipe string so as to move the pipe string into alignment with the center of the slip bowl.

12. An apparatus for centering a pipe string within a slip bowl to facilitate the setting of a set of slips about the pipe string, the slip bowl disposed in a floor of a drilling rig and the pipe string suspended from the drilling rig so that the pipe string extends downwardly through the slip bowl and into a well bore, the center of the slip bowl defining a centerline, the apparatus comprising:

a housing connected to the rig below the floor of the rig, the housing adapted to receive a portion of the pipe string; a first pair of cylinders mounted to the interior of the housing, each cylinder having a first end, a second end, a piston slidingly disposed therein, and a rod connected to the piston and extending from the second end of the cylinder, the first end of each cylinder connected to the housing such that the cylinders are symmetrically spaced relative to a first axis extending perpendicular from the centerline of the slip bowl;

a first cable having one end connected to one of the rods of the first pair of cylinders and the other end connected to the other cylinder, the first cable being looped about at least a portion of the pipe string;

a second pair of cylinders mounted to the interior of the housing, each cylinder having a first end, a second end, a piston slidingly disposed therein, and a rod connected to the piston and extending from the second end of the cylinder, the first end of each cylinder connected to the housing such that the second pair of cylinders are symmetrically spaced relative to the first axis and such that the first and second pair of cylinders are symmetrically spaced relative to a second axis, the second axis being perpendicular to the centerline of the slip bowl and perpendicular to the first axis;

a second cable having one end connected to one of the rods of the second pair of cylinders and the other end connected to the other cylinder, the second cable being looped about an opposing portion of the pipe string; and actuating means for selectively actuating the rods of the first and second pairs of cylinders between an extended position where the first and second cables are in a nonengaging relation with the pipe string and a retracted position where the first and second cables cooperatively engage the pipe string so as to move the pipe string into alignment with the center of the slip bowl.

13. The apparatus of claim 12 wherein each of the first and second cables are flexible, and wherein each of the cylinders of the first and second pair of cylinders is pivotally connected to the rig so that the cylinders are movable along a plane perpendicular to the centerline of the slip bowl whereby the rods of the first and second pair of cylinders tangentially align with the pipe string when the rods are in the retracted position.

14. The apparatus of claim 13 further comprising:

biasing means for urging the first end of each of the cylinders outwardly from the pipe string when the rods are in the extended position to project the first and second cables away from the pipe string in a non-engaging relation when the rods are in the extended position.

15. An apparatus for centering a pipe string within a slip bowl to facilitate the setting of a set of slips about the pipe string, the slip bowl disposed in a floor of a drilling rig and the pipe string suspended from the drilling rig so that the pipe string extends downwardly through the slip bowl and into a well bore, the center of the slip bowl defining a centerline, the apparatus comprising:

pipe engaging means mounted to the drilling rig for selectively engaging the pipe string and moving the pipe string into alignment with the center of the slip bowl, the pipe engaging means comprising:

a first pair of cylinders, each cylinder having a first end, a second end, a piston slidingly disposed therein, and a rod connected to the piston and extending from the second end of the cylinder;

a first cable having one end connected to one of the rods of the first pair of cylinders and the other end connected to the other cylinder, the first cable being looped about at least a portion of the pipe string;

a second pair of cylinders, each cylinder having a first end, a second end, a piston slidingly disposed therein, and a rod connected to the piston and extending from the second end of the cylinder;

a second cable having one end connected to one of the rods of the second pair of cylinders and the other end connected to the other cylinder, the second cable being looped about an opposing portion of the pipe string; and actuating means for selectively actuating the rods of the first and second pairs of cylinders between an extended position where the first and second cables are in a nonengaging relation with the pipe string and a retracted position where the first and second cables cooperatively engage the pipe string so as to move the pipe string into alignment with the center of the slip bowl.

16. The apparatus of claim 15 wherein the first ends of the cylinders of the first pair of cylinders are symmetrically spaced relative to a first axis extending perpendicular from the centerline of the slip bowl, wherein first ends of the cylinders of the second pair of cylinders are symmetrically spaced relative to the first axis, and wherein the first and second pair of cylinders are symmetrically spaced relative to a second axis, the second axis being perpendicular to the centerline of the slip bowl and perpendicular to the first axis.

17. The apparatus of claim 15 wherein each of the first and second cables are flexible, and wherein each of the cylinders of the first and second pair of cylinders is pivotally connected to the rig so that the cylinders are movable along a plane perpendicular to the centerline of the slip bowl whereby the rods of the first and second pair of cylinders tangentially align with the pipe string when the rods are in the retracted position.

18. The apparatus of claim 17 further comprising:

biasing means for urging the first end of each of the cylinders outwardly from the pipe string when the rods are in the extended position to project the first and second cables away from the pipe string in a non-engaging relation when the rods are in the extended position.

19. An apparatus for centering a pipe string within a slip bowl to facilitate the setting of a set of slips about the pipe string, the slip bowl disposed in a floor of a drilling rig and the pipe string suspended from the drilling rig so that the pipe string extends downwardly through the slip bowl and into a well bore, the apparatus comprising:

pipe engaging means mounted to the drilling rig for selectively engaging the pipe string and moving the pipe string into alignment with the center of the slip bowl; and a housing mounted to the rig underneath the floor thereof, the housing configured to receive the pipe string and substantially encase the pipe engaging means.

20. An apparatus for centering a pipe string within a slip bowl to facilitate the setting of a set of slips about the pipe string, the slip bowl disposed in a floor of a drilling rig and the pipe string suspended from the drilling rig so that the pipe string extends downwardly through the slip bowl and into a well bore, the center of the slip bowl defining a centerline, the apparatus comprising:

pipe engaging means mounted to the drilling rig for selectively engaging the pipe string and moving the pipe string into alignment with the center of the slip bowl, the pipe engaging means comprising:

a plurality of cylinders, each cylinder having a first end, a second end, a piston slidingly disposed therein, and a rod connected to the piston and extending from the second end of the cylinder, the first end of each cylinder connected to the rig below the floor thereof such that the cylinders are radially positioned relative to the centerline of the slip bowl and spaced substantially an equal distance apart;

a pipe engaging member provided at the second end of each rod;

actuating means for selectively actuating the rods of the cylinders between a retracted position where the pipe engaging members are in a non-engaging relation with the pipe string and an extended position where the pipe engaging members cooperatively engage the pipe string so as to push the pipe string into alignment with the center of the slip bowl.

21. The apparatus of claim 20 wherein adjacent pipe engagement members are vertically spaced apart.

* * * * *

UNITED STATES PATENT AND TRADEMARK OFFICE

CERTIFICATE OF CORRECTION

PATENT NO. : 5,595,248

DATED : January 21, 1997

INVENTOR(S) : Larry Denny

It is certified that error appears in the above-identified patent and that said Letters Patent is hereby corrected as shown below:

In the drawings, Figure 4A, reference numeral "120" associated with the spring should be changed to --140--.

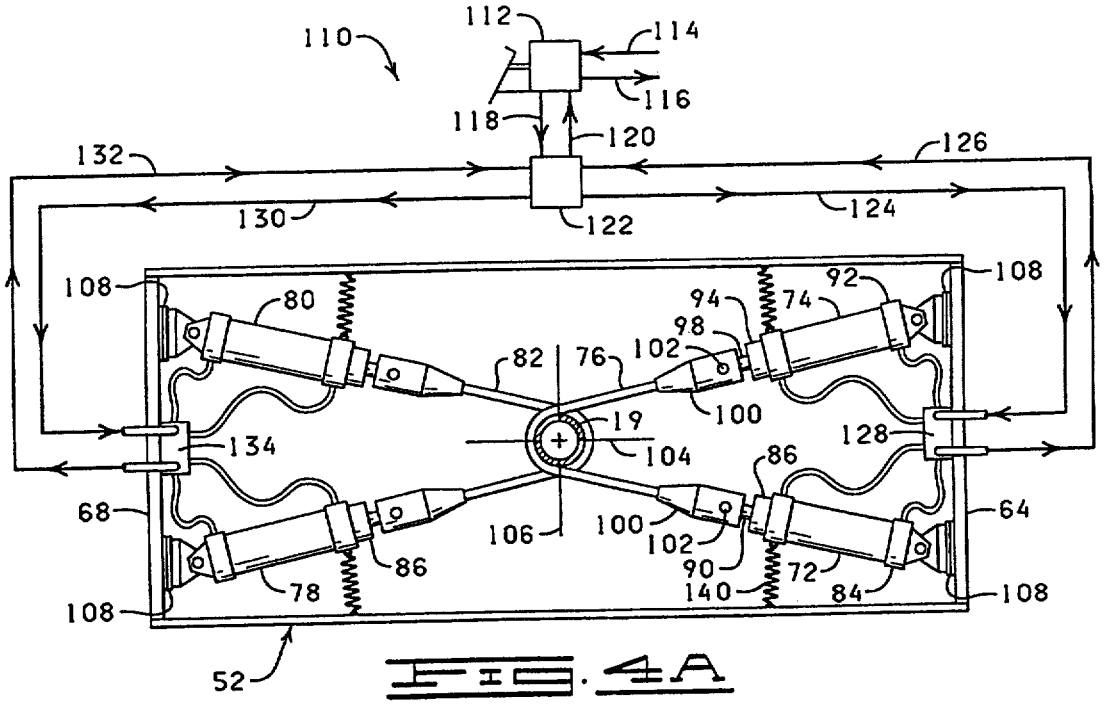

FIG. 4A

UNITED STATES PATENT AND TRADEMARK OFFICE

CERTIFICATE OF CORRECTION

PATENT NO. : 5,595,248

DATED : January 21, 1997

INVENTOR(S) : Larry Denny

It is certified that error appears in the above-identified patent and that said Letters Patent is hereby corrected as shown below:

In the drawings, Figure 4B, reference numeral "120" associated with the spring should be changed to --140--.

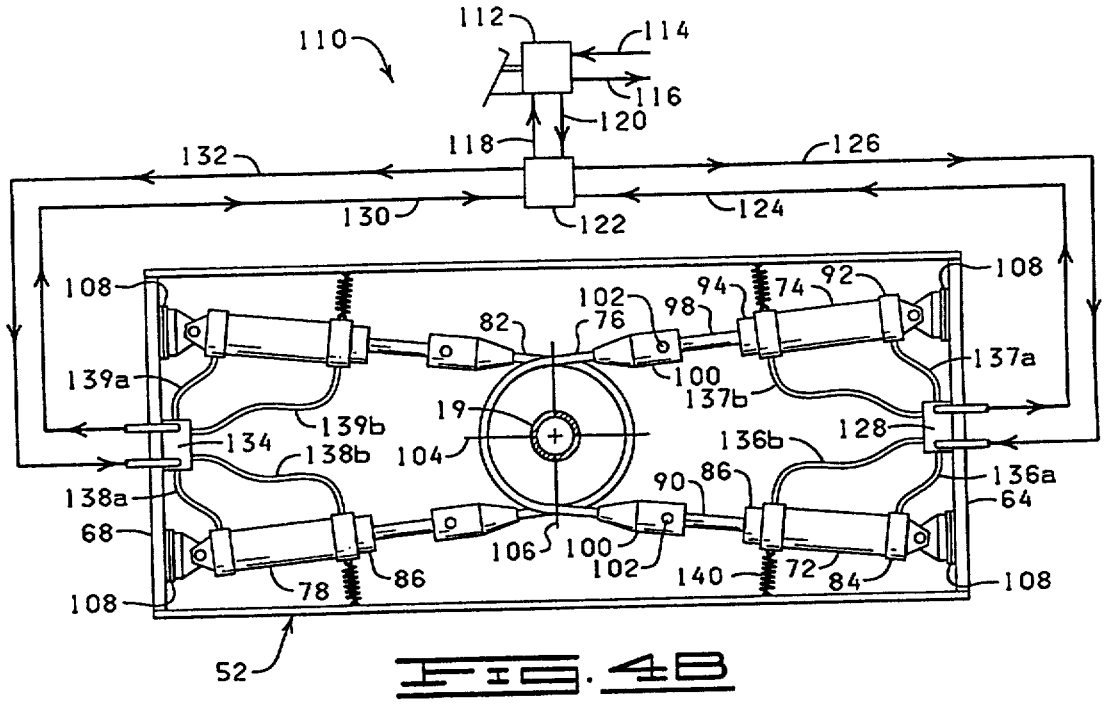

FIG. 4B

UNITED STATES PATENT AND TRADEMARK OFFICE

CERTIFICATE OF CORRECTION

PATENT NO. : 5,595,248

DATED : January 21, 1997

INVENTOR(S) : Larry Denny

It is certified that error appears in the above-identified patent and that said Letters Patent is hereby corrected as shown below:

Column 2, line 60, delete "slips 24" and substitute therefor --slips 28--.

Column 2, line 62, delete "slips 24" and substitute therefor --slips 28--.

Column 4, line 58, delete "fluid control assembly 110" and substitute therefor --plumbing assembly 110--.

Column 5, line 2, delete "tension spring 120" and substitute therefor --tension spring 140--.

Column 5, line 4, delete "springs 120" and substitute therefor --springs 140--.

Column 5, line 6, delete "spring 120" and substitute therefor --spring 140--.

Column 5, line 7, delete "spring 120" and substitute therefor --spring 140--.

Column 5, line 61, delete "rod 160" and substitute therefor --rod 162--.

Column 5, line 62, delete "extended" and substitute therefor --extend--.

UNITED STATES PATENT AND TRADEMARK OFFICE

CERTIFICATE OF CORRECTION

PATENT NO. : 5,595,248

DATED : January 21, 1997

INVENTOR(S) : Larry Denny

It is certified that error appears in the above-indentified patent and that said Letters Patent is hereby corrected as shown below:

Column 6, line 15, delete "pipe engaging members 162" and substitute therefor --pipe engaging members 164--.

Signed and Sealed this

Sixth Day of May, 1997

*Attest:*

*Attesting Officer*

BRUCE LEHMAN

*Commissioner of Patents and Trademarks*